US010895152B1

(12) United States Patent
Young, III et al.

(10) Patent No.: US 10,895,152 B1
(45) Date of Patent: Jan. 19, 2021

(54) BOREHOLE SEALING AND IMPROVED FOAM PROPERTIES FOR CONTROLLED FOAM INJECTION (CFI) FRAGMENTATION OF HARD COMPACT MATERIALS

(71) Applicant: CFI Technologies, Inc., Steamboat Springs, CO (US)

(72) Inventors: Chapman Young, III, Steamboat Springs, CO (US); J. Roberto Frias, Steamboat Springs, CO (US)

(73) Assignee: CFI Technologies, LLC, Steamboat Springs, CO (US)

( * ) Notice: Subject to any disclaimer, the term of this patent is extended or adjusted under 35 U.S.C. 154(b) by 44 days.

(21) Appl. No.: 15/943,041

(22) Filed: Apr. 2, 2018

Related U.S. Application Data

(60) Provisional application No. 62/479,427, filed on Mar. 31, 2017.

(51) Int. Cl.

| | |
|---|---|
| ***E21C 37/12*** | (2006.01) |
| ***E21C 37/14*** | (2006.01) |
| *E21B 33/12* | (2006.01) |
| *E21B 33/128* | (2006.01) |

(52) U.S. Cl.
CPC ..... *E21C 37/12* (2013.01); *E21C 37/14* (2013.01); *E21B 33/1208* (2013.01); *E21B 33/1285* (2013.01)

(58) Field of Classification Search
CPC ..... E21C 37/06; E21C 37/12; E21C 37/14; E21B 33/12; E21B 33/1208; E21B 33/128; E21B 33/1285; E21B 33/13; E21B 33/14; E21B 33/16; E21B 43/162; E21B 43/164; E21B 43/166; E21B 43/168; E21B 43/26; E21B 43/261; E21B 43/267; E21B 33/10; E21B 2033/105; E21B 33/138
USPC ..... 166/177.5, 387
See application file for complete search history.

(56) References Cited

U.S. PATENT DOCUMENTS 4,363,518 A * 12/1982 Nakamura ..... E21C 37/06 166/308.1
4,991,653 A * 2/1991 Schwegman ..... E21B 23/006 166/191
5,098,163 A * 3/1992 Young, III ..... E21C 37/14 299/13
6,102,484 A * 8/2000 Young, III ..... E21C 37/12 166/177.5

(Continued)

*Primary Examiner* — Janine M Kreck
*Assistant Examiner* — Michael A Goodwin
(74) *Attorney, Agent, or Firm* — James Creighton Wray

(57) ABSTRACT

Breaking rock and concrete, based upon a Controlled-Foam Injection or PCF (Penetrating Cone Fracture) uses a high-pressure fluid to pressurize a pre-drilled hole. A high pressure seal is formed between the injection barrel and walls of the pre-drilled hole in the material to be broken. A leak-free poppet valve holds a fluid in a pressure vessel before rapid discharge. Variable charges of foam/water are generated and delivered to the breaker. The injection barrel is prefilled with a low viscosity fluid. An annular reverse acting poppet valve allows concurrent injection of chemical additives and/or micro particles to modify foam viscosity during its high pressure release into the material to be broken. A high pressure foam generator is compact and reliable. Removal and wash-out of the seal frees the injection barrel.

20 Claims, 11 Drawing Sheets

(56) References Cited

U.S. PATENT DOCUMENTS

| | | | | |
|---|---|---|---|---|
| 6,375,271 | B1 * | 4/2002 | Young, III | E21C 37/12 166/177.5 |
| 2016/0024894 | A1 * | 1/2016 | Campbell | E21B 33/1243 166/278 |
| 2018/0163510 | A1 * | 6/2018 | Cleven | E21B 34/10 |

* cited by examiner

BOREHOLE SEALING AND IMPROVED FOAM PROPERTIES FOR CONTROLLED FOAM INJECTION (CFI) FRAGMENTATION OF HARD COMPACT MATERIALS

This application claims the benefit of U.S. Provisional Application No. 62/479,427 filed Mar. 31, 2017, which is hereby incorporated by reference in its entirety as if fully set forth herein.

SUMMARY OF THE INVENTION

The invention provides improvements to the method and apparatus for breaking rock and concrete, based upon a Controlled-Foam Injection or PCF (Penetrating Cone Fracture) process wherein a high-pressure fluid is used to pressurize a pre-drilled hole of appropriate geometry. The invention provides automated methods, apparatus and techniques for forming a high pressure seal between the injection barrel and the walls of the prerequisite pre-drilled hole in the material to be broken and removal and wash-out of said seal to free the injection barrel from its location. Improved leak free poppet valves hold a fluid in a pressure vessel and rapidly discharge it. Generating and delivering variable charges of foam and water to the breaker includes prefilling the injection barrel with a low viscosity fluid. An annular reverse acting poppet valve allows concurrent injection of chemical additives and/or micro particles to modify foam viscosity during its high pressure release into the material to be broken. An improved high pressure foam generator construction is compact and reliable, and allows PLC control.

The current invention provides improvements to continuous excavation/demolition systems based upon the controlled fracturing of hard competent rock and concrete by Controlled Foam Injection (CFI) and Penetrating Cone Fracture (PCF) processes. Both CFI and PCF methods as outlined in commonly owned U.S. Pat. Nos. 6,375,271 and 5,098,163 deliver a pressurized fluid to the bottom of a hole previously drilled into the material to be broken. U.S. Pat. Nos. 6,375,271 and 5,098,163 are hereby incorporated by reference in their entirety as if fully set forth herein.

The efficiency of the CFI and PCF methods in terms of energy usage is highly dependent on the efficacy of the seal between the injection barrel and the borehole. In terms of their operating effectiveness, both methodologies are dependent on the ability to automate hole boring, barrel and seal emplacement and barrel removal operations in order to achieve minimum cycle times.

To this end, the assignee has developed a novel and fully automated sealing system. This new PLC (Programmable Logic Controller) based pneumatic system automatically delivers a sufficient volume of sand directly to the seal cavity. Furthermore, it engages the hydraulic system to effectively crush the sand in the sand filled cavity to form a very effective high pressure seal.

Field testing revealed the need to occasionally free the injection barrel from the host rock. It was found that breakage by CFI process occasionally resulted in the injection barrel remaining locked in a portion of the host rock, containing an intact sand seal in the borehole. The present invention through the direct delivery of compressed air and pressurized water provides the means to wash out the remains of the sand seal, thus enabling the extraction of the injection barrel from the borehole at will.

In the present invention, an improved poppet is described with a novel self-aligning conical valve seat that reduces leakage and enhances operational durability and resilience against surface defects. By preventing premature leakage of the pressurized fluid into the material to be broken, the probability of inadvertent and untimely breakage is significantly reduced and eliminated.

The host material to be broken varies physically in terms of porosity, parting plane geometry, discontinuities and composition. These variations may adversely affect the fracture size, sometimes developing large enough gaps that result in incomplete breakage of the host rock. To avoid this result it is desirable to dramatically increase the viscosity of the foam as it is travels through the fractures so that high foam injection pressures are maintained. This invention describes a unique annular poppet apparatus capable of injecting a pressurized stream of reactive liquid simultaneously into the main flow release of foam that will subsequently increase the foam viscosity.

The present invention provides both method and apparatus for automating the formation and optional removal of a high-pressure sand seal without the adverse penalties of manual operations and consequent delays.

The invention includes a Programmable Logic Controlled (PLC) pneumatic sand delivery system capable of metering, transporting and placing a sufficient quantity of the preferred sand from a pressurized sand hopper to the seal annular compartment or cavity. Both the seal cavity and the sand are dimensioned such that the cavity captures the sand and holds it firmly in place. Following the sand placement, the PLC or operator can engage hydraulic valving that actuates the crushing and packing of the captured sand and forms it into a fine granular and compact annular layer seal. This crushed sand layer creates a high-pressure seal that tightly locks the injection barrel into the borehole and prevents leakage between the hole bottom and the exterior. By locking the barrel in position against the material to be broken, recoil forces are minimized or eliminated thus reducing the cyclic stresses on the carrier and equipment.

The seal is effective even when the drilled borehole is not circular or uniform and is of varying diameter. These are all realities in rotary percussive drilling and the new seal is effective in all these application.

The sand is kept dry in a mine environment of 100% humidity and dry sand is kept in the hopper.

The injection barrel position lock provided by the sand seal proves sufficiently effective to occasionally necessitate a technique of freeing the injection barrel from the material to be broken. The preferred embodiment of the invention provides the method and means of liberating the injection barrel by washing out the crushed sand seal. The present invention incorporates porting and valving within the apparatus to enable the selective delivery of a comingled flow of compressed air and pressurized water down along the injection barrel directed at the crushed sand seal annulus. The turbulence and agitation of the comingled stream combined with the oscillatory movement of the crush tube erodes and washes out the exposed finely crushed sand, thus effecting the removal of the seal and the release of the barrel.

Any leakage of the pressurized fluid into the sealed borehole through a poppet valve can result in the premature and unexpected sudden breakage of the host material. In an effort to mitigate the potential for such premature breakage, the present invention incorporates an improved poppet valve with a hard-conical cross-sectional piston that self-aligns against a softer mating conical seat. Under pressure, the harder poppet piston can mechanically deform any seat surface imperfections and conform hermetically to its mating surface, thus eliminating subsequent leakage. The large surface area afforded by the conical seat, forces the poppet piston to conform to any axial misalignment between them and be held in a stable position by the fluid back pressure.

The footprint of the high pressure foam generator has been minimized by housing the viscosity enhancing chemical injection apparatus internally. In previous embodiments, this apparatus was housed externally as an additional narrow piston/cylinder extension to the main body. This shorter internal construction eliminates this failure possibility and additionally limits concentric misalignments between cylinder walls and pistons.

DETAILED DESCRIPTION

Figure 1:
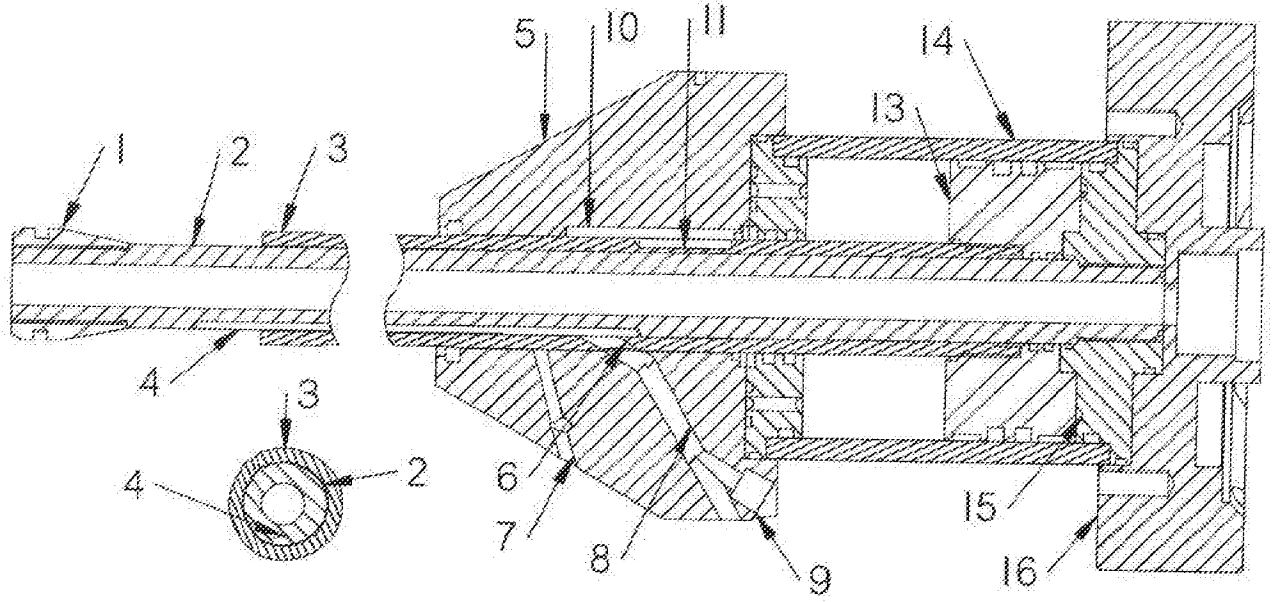
FIG. 1 is a foreshortened detailed cutaway side view of the injection barrel and crush tube subassembly in a retracted position for the automated delivery of sand to the sand seal cavity.

The automated seal placement system includes the following elements: a PLC (Programmable Logic Controller) controlled air pressurized sand hopper and metering apparatus, pressure resistant hoses and conduits linking the sand hopper to the breaker barrel shown in FIG. 1, and the seal cavity within the host rock formed in the void between the barrel, barrel bulb tip, borehole and crush tube end. Appropriate sand and a low-pressure compressor capable of delivering a steady and sufficient flow of compressed air to the system are also needed.

Figure 2:
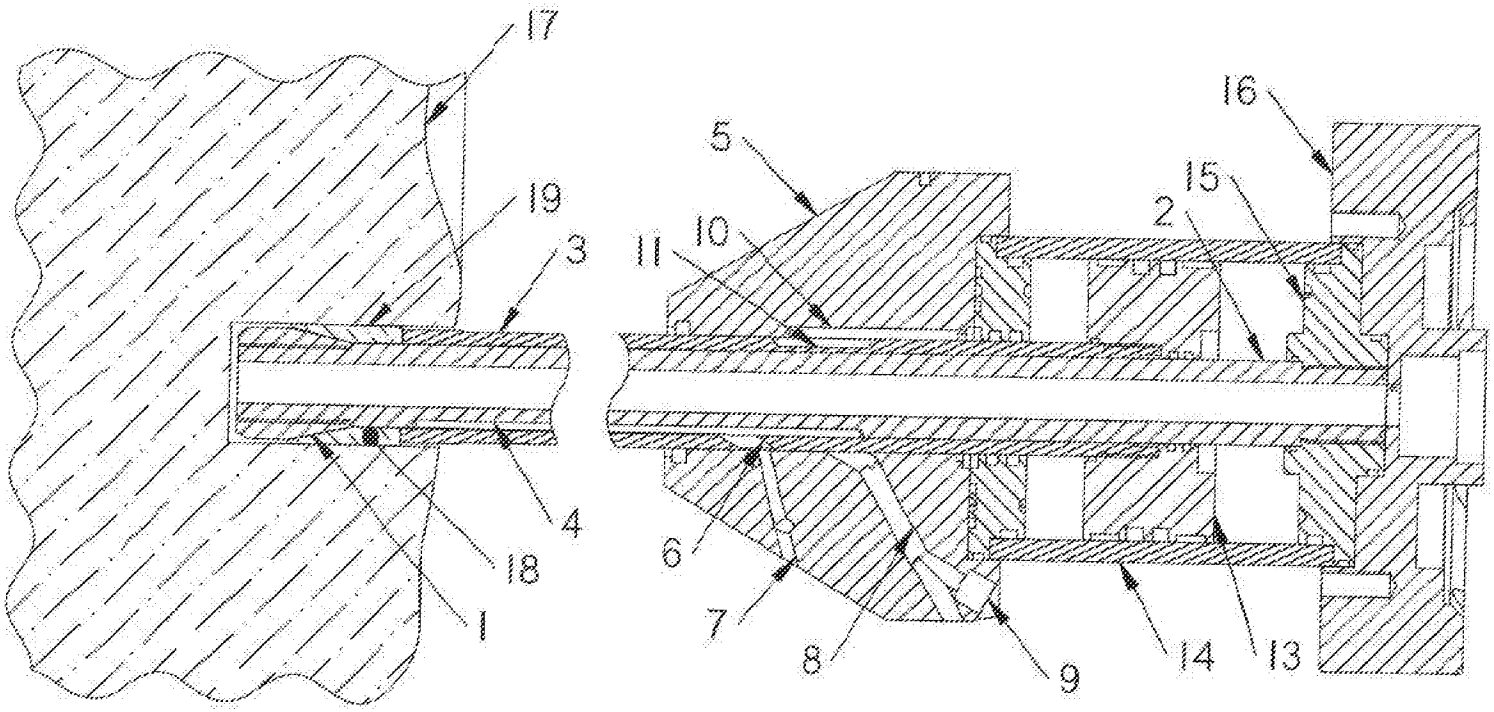
FIG. 2 is a foreshortened detailed cutaway side view of the injection barrel and crush tube subassembly in an extended position, showing the device inserted in a pre-drilled hole after sand seal emplacement locking the barrel in the host rock.
Figure 3:
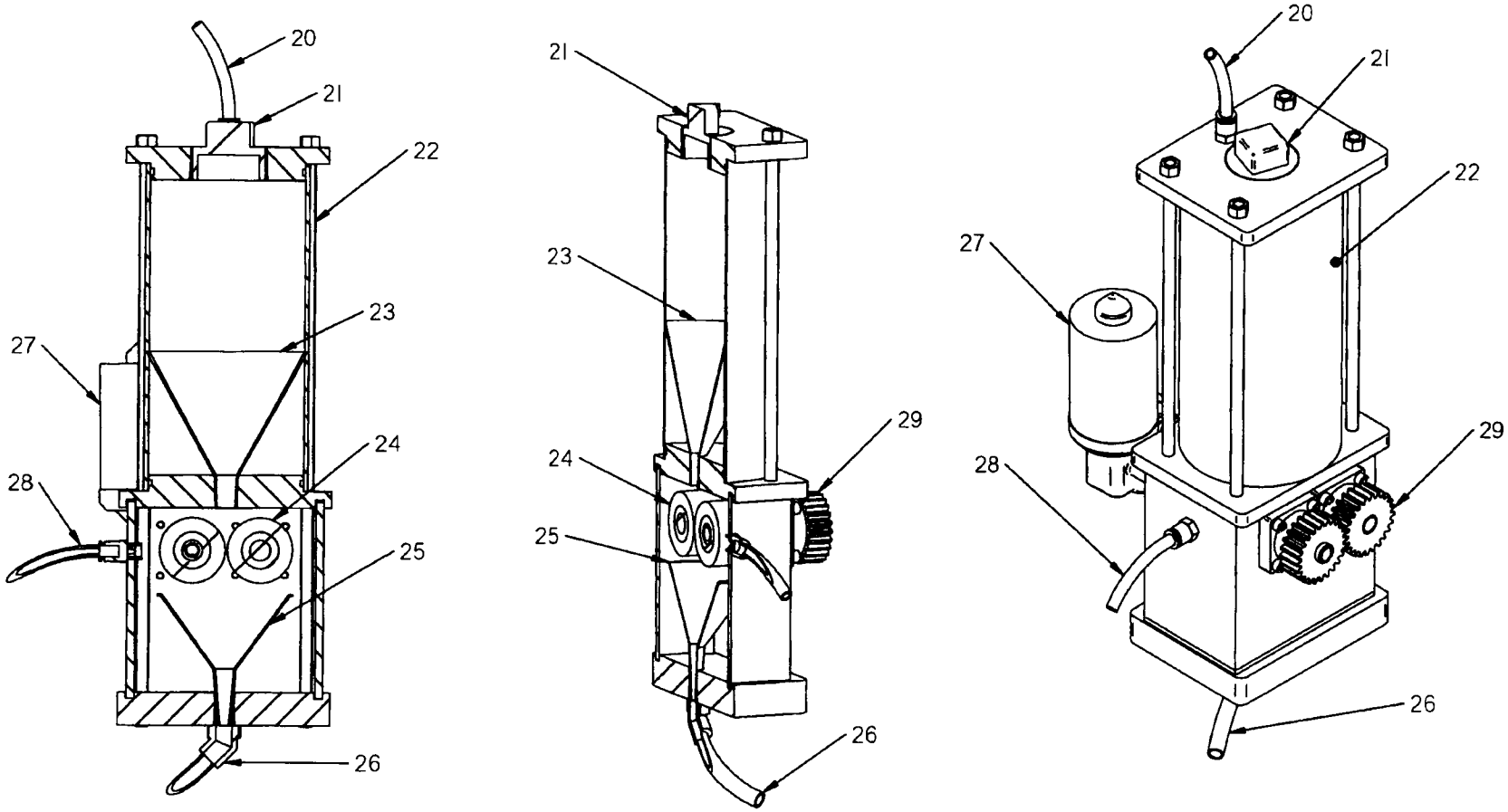
FIG. 3 shows side cross-sectional, perspective cross-sectional and perspective views and cross-sections of the present PLC controlled pneumatic sand delivery apparatus.

In one embodiment of the present invention, the automated seal emplacement is accomplished by first pre-drilling the host rock and inserting the retracted breaker barrel 2 assembly of FIG. 1 into the borehole 19 as shown in FIG. 2. As depicted in FIG. 1, the crush tube 3 and crush piston assembly 13 is initially in its retracted position, thus connecting the sand groove 4 to the nose cone 5 sand port 9 through crush tube opening 6. The seal emplacement operation is initiated at will by the operator of the continuous mining machine, by simply pressing a button on a suitable control panel that transmits the command to the PLC. The PLC is appropriately programmed to open a pneumatic electro valve that opens compressed air flow to the sand hopper that has a lid 21 in FIG. 3. This in turn pressurizes the entire hopper 22 through inlet ports 20 and 28 which are sealed except for the sand delivery port 26. A steady flow of air is established through this port 26 and through its connected hose, all the way to the breaker nose assembly in FIG. 1. The air enters the nose cone through inlet port 9, travels the open path provided by hole 8 traverses an elliptical opening 6 in the crush tube 3 and is routed down the groove between the semicircular channel 4 in barrel 2 and the outside surface of the crush tube 3. The air finally reaches the seal cavity 18 where it expands out and eventually reaches atmospheric pressure by reaching out of the borehole 19 and into the exterior. This initial flow of air is necessary to: a) appropriately pressurize the sand hopper 22 and metering apparatus 24; b) clear all lines and conduits; c) remove any residual water and cuttings from the borehole left as a result of its drilling.

After a suitable period of time, the PLC then activates a relay that turns on roller motor 27 on the sand hopper 22 while still maintaining it pressurized and with a continuous flow of air. The rollers 24 are geared together 29 and begin counter rotating against each other, thus metering vertically, a steady stream of sand in through funnel 23 and out through funnel 25. The gaps between the rollers are calibrated to meter an optimal flow of sand into the air flow stream and to avoid stoppage or plugging of the lines by excessive sand volume.

The sand thus fed enters the stream flow of compressed air 26 and travels with it all the way to the seal cavity 18. The grains of sand are of such a diameter that the majority of them are trapped in the seal cavity 18 as they are too large to escape to the exterior through the gaps between the borehole wall 19 and the crush tube 3 or to the hole bottom through the gap between the borehole 19 and the conical bulb tip 1 that forces the sand outward. Once sufficient sand has been delivered to the sand seal cavity 18, the PLC automatically de-activates the roller motor relay, stopping any further sand delivery down funnel 25 and into the sand feed lines through outlet port 26. During and for a predetermined short period of time after, the PLC maintains the steady flow of air down the sand lines and to the sand seal cavity 18. This ensures that the lines and conduits are cleared of any remaining sand and prevents settling of the sand into accumulations that could cause stoppages or plugging.

The PLC then closes the pneumatic electro valve that stops compressed air flow to the sand hopper 22. All air pressure in the hopper 22 is vented through the sand line 26 to the exterior. The PLC or operator now sequences the crushing of the sand accumulated in the sand seal cavity 18 by actuating the electrohydraulic valve that ports hydraulic fluid pressure into the crush tube cylinder 14. During the extension of the crush tube, the PLC monitors two suitable sensors, one measures the distance traveled by the crush tube and the other measures the hydraulic pressure acting on the crush tube piston 13. Alternatively, the PLC software can numerically calculate an estimate of the crush tube travel with just one pressure sensor. To compute the estimate, the PLC software first measures the time interval taken between the activation of the crush tube and the resulting pressure peak at end of travel and then multiplies that time by the pre-established constant extension velocity of the crush tube. Once at end of travel, the PLC compares the distance traveled by the crush tube 3 to a predetermined maximum. If the traveled distance by the crush tube is below this threshold, the PLC determines a successful seal emplacement and crush operation. The operator is notified appropriately by a suitable pilot light on the control console. If, however the distance exceeds the threshold, the PLC sets an error pilot light to alert the operator of the failure of the seal emplacement operation. In this way, the operator is notified of the success or failure of the automated seal placement and can proceed appropriately with either subsequent breakage operations or further seal emplacement efforts.

During the subsequent hole bottom pressurization, the crush tube 3 remains under significant force, pressed against the annular sand seal 18 by action of the hydraulic pressure acting on piston 13 that remains trapped in the cylinder 14. The bulb tip 1 is in contact with the sand seal through its unique conical outer surface. By compressing the seal between this surface and the crush tube 3 end, a significant portion of the compressive load is transferred radially and equally to both the seal cavity borehole walls and the corresponding barrel/crush tube outer surface. The trapped sand is thus crushed into a fine siliceous powder that forms a remarkably impervious seal. In addition, the seal firmly binds the barrel 2 to the host rock 17 through the resulting seal's outstanding coefficient of friction.

The conicity of the bulb tip 1 is defined by the angle between the barrel axis and its surface. A nominal angle of 20 degrees is used and is shown in the preferred embodiment. However, that angle can be varied and optimized for specific rock types, fracture patterns and ease of barrel extraction.

In FIG. 2 the crush tube 3 is extended such that the sand groove 4 is isolated from the seal cavity 18, thus preventing stoppage of the sand barrel groove 4 by accumulation of crushed sand at its end. Concurrently, the crush access tube hole 6 is aligned with the wash out port 7 in nose cone 5, thus enabling the barrel groove 4 to act as a conduit for seal wash out fluids. Once the seal 18 has been emplaced, the barrel assembly can be extracted from the borehole 19 most easily by the effective removal of the crushed sand seal. This operation is initiated when the operator activates a set of electro valves that directs a stream of comingled water and pressurized air into the nose cone wash out port 7 through an appropriate hose. This jet is directed through crush tube access hole 6 into barrel groove 4 which leads directly to the annular seal cavity 19. The agitation provided by the turbulent flow of the comingled stream will erode the crushed sand material and cause the fine particles to be transported to the exterior of the borehole. To aid seal erosion, the operator hydraulically oscillates the crush tube, further agitating and dislodging the crushed sand seal particles and suspending them within the surrounding stream of bubbling water. Repeated crushing of the sand by the crush tube 3 reduces the particles to a fine dust that once suspended in the wash out fluid easily escapes through the surrounding borehole 19 gaps to the exterior. The comingled stream of water and air is prevented from back flowing into the nose cone sand conduit hole 8 by the portion of the crush tube that now covers the opening Radial alignment of the nose cone access ports 8 and 7 with the crush tube access hole 6 is maintained by a pair of semicircular mating grooves 10, 11 that capture a ball bearing of suitable diameter. The ball bearing is free to slide along the grooves and prevents any axial rotation of the crush tube as it is extended or retracted. Likewise, the sand groove 4 of the barrel 2 is locked in alignment with crush tube access hole 6 during assembly. The significant compressive force exerted against the barrel flange 15 by the hydraulic cylinder 14 as the nose cone 5 is bolted on to the center plate 16 impedes any inadvertent rotation during operation.

The sand grain size, mineral composition and geometry aid emplacement and effectiveness of the seal. Sand that includes a majority of grains that are not sufficiently rounded or too moist and or contain oversized particles is prone to create stoppages and plugs within the conduits during seal emplacement. Sand that is of insufficient diameter will not be trapped in the seal cavity 18 and thus escape to either the exterior or the hole bottom. Sand whose mineral composition does not include sufficient quartz may not offer a sufficient coefficient of friction to prevent the barrel from escaping when the bottom of the hole is fully pressurized. Field tests show that the ideal sand grain is 8-12 sieve size is well rounded and crushes to a fine powder. "Frac Sand", which is sand mostly used as proppant in the oil industry, has been successfully tested in this method and provides ideal specifications. Synthetic proppants, such as sintered bauxite, although not yet tested, might satisfy the preferred specifications.

The quartz sand placement and sealing system can also be used in conjunction with a conventional propellant based rock breaking method (PCF) which would reduce the energy, and thus the charge size required for adequate breakage of the rock or concrete. Consequently, the reduced charge size would minimize the adverse effects of high air blast, fly rock, toxic fumes and noise associated with standard PCF breaks.

Figure 4:
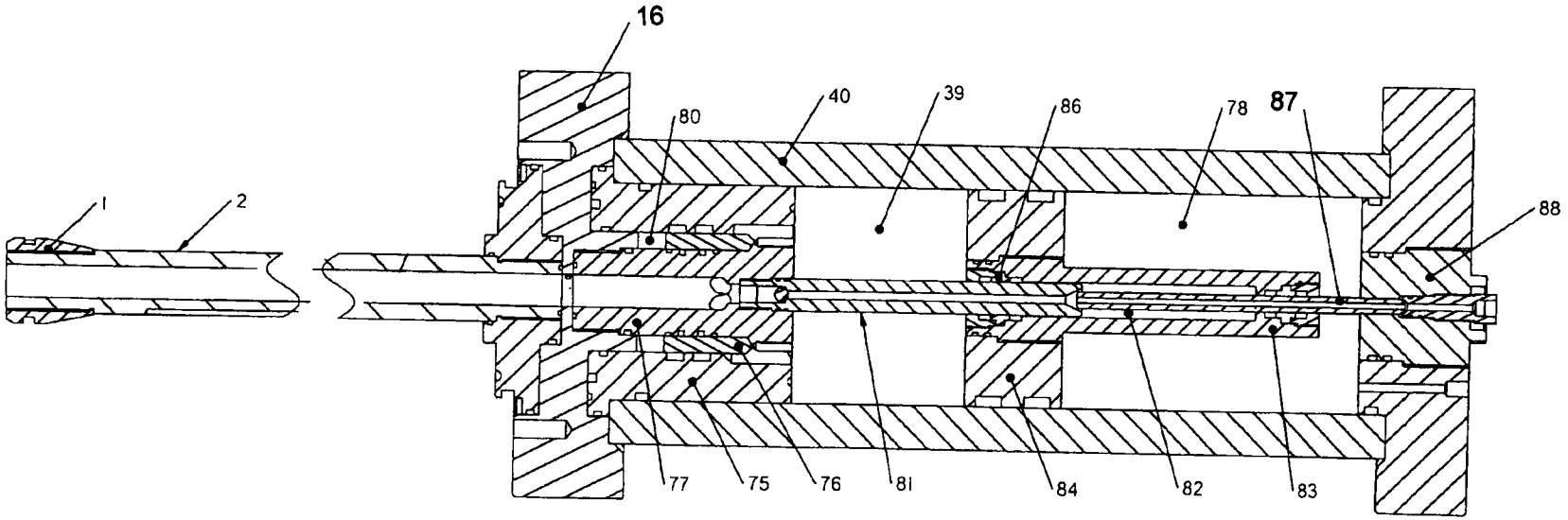
FIG. 4 is a detailed cross-sectional view of the barrel and the annular poppet valve for injecting modifying agents into the main foam release flow.

A cross-sectional view of an improved CFI breaker is shown in FIG. 4. A specialized annular poppet valve allows for the simultaneous injection of a liquid chemical into the flow of foam during its release. The addition of the chemical serves to increase the foam viscosity or alter its composition so as to improve its rock breaking characteristics.

The injection of a cross linker, or other liquid foam modifying chemical, is effected by the differential motion of the smaller injection tube 81, acting as a piston, inside the injection cavity 82 in the injection cylinder 83. The injection cylinder 83 is threaded into the foam piston 84 and is displaced along with the foam piston as foam is released down the barrel. Appropriate high-pressure seals 86 isolate the injection chamber from the high-pressure foam 39 and the high-pressure air pad 78 compartments. The rapid change in volume of the chemical chamber 82 occurs simultaneously with and proportional to the release of foam down the barrel 2, thus forcing the modifying chemical out of tube 81 and into the throat 92 of the poppet core shown in FIGS. 5*a* and 5*b*. The foam thus is comingled with the injected chemical on its travel through the barrel, and the desired change in viscosity or breaking characteristics is achieved during the breakage process.

Figure 8:
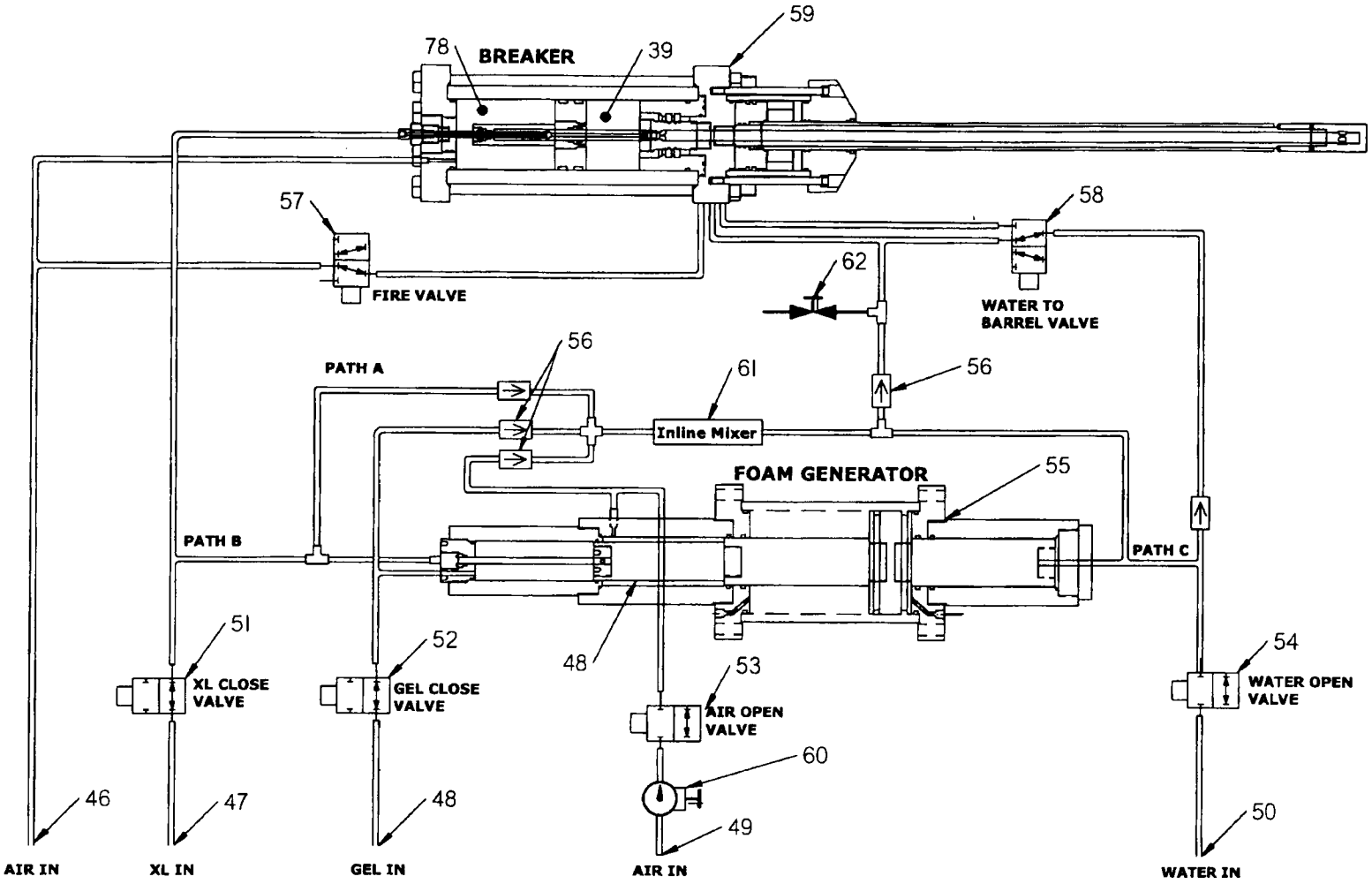
FIG. 8 shows a double acting foam generating system with a pressure regulator capable of supplying foam with variable gas quality and viscosity enhancing chemicals to the breaker.

The chemical liquid is replenished in the injection cavity 82 through the fixed tube 87 from the foam generator 55 shown in FIG. 8 and occurs simultaneously with the delivery of the foam load to the breaker 59 in FIG. 8. The tube 87 also provides a sliding seal between the motion of the injection cylinder 83, and the Breaker air pad compartment 78. It is threaded directly into the rear breaker plug 88.

Figure 5A:
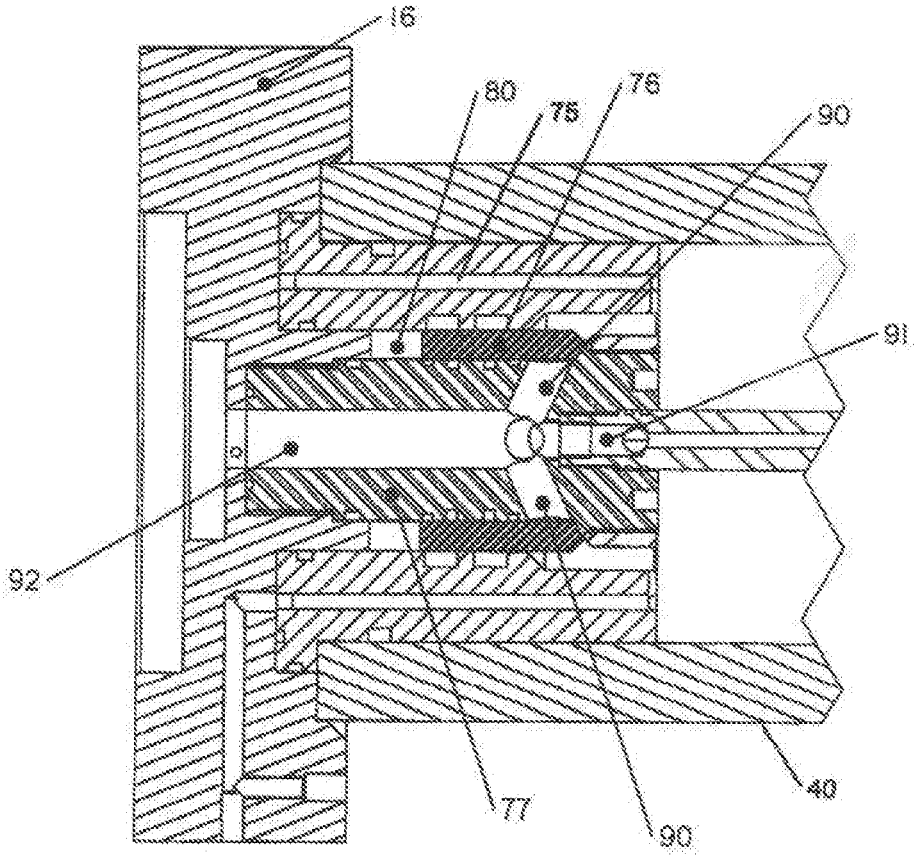
FIGS. 5*a* and 5*b* are a close-up view of the annular poppet valve depicted in FIG. 4 with the piston seal closed and open, respectively.
Figure 5B:
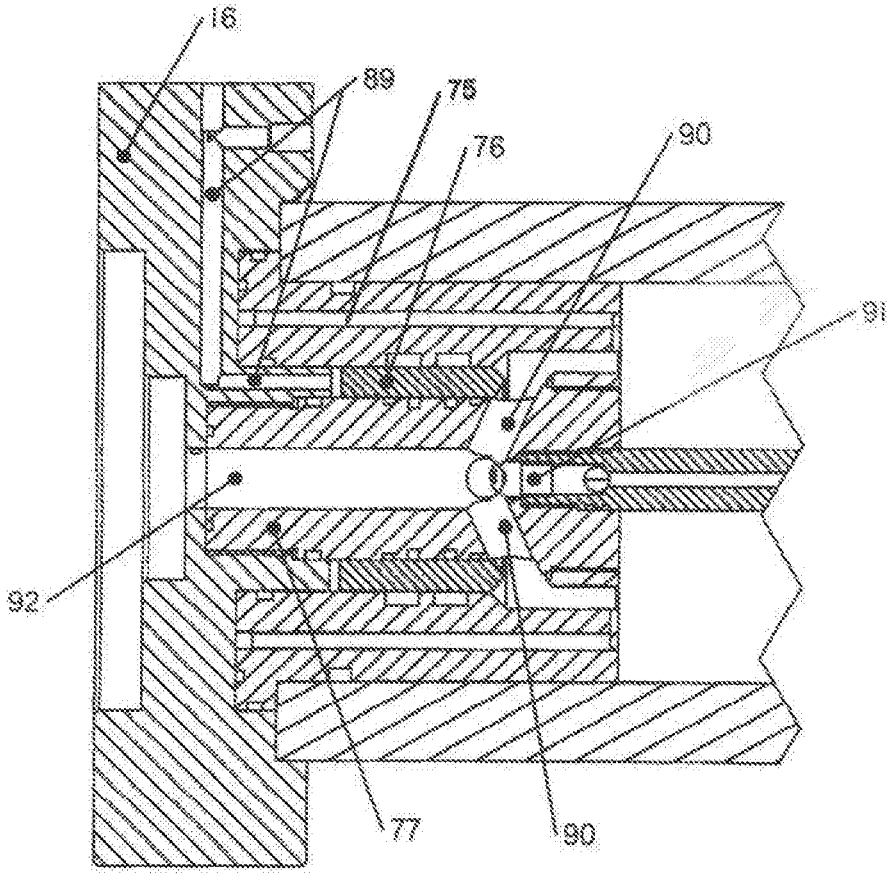

A close-up view of the annular type poppet is shown in FIGS. 5*a* and 5*b* within the main foam cylinder 40 and is composed of an internal poppet cylinder 75, annular poppet piston 76 and the poppet core 77. The through hole poppet valve allows for access to the inside of the barrel 4 for injecting selected additives to the flow of high-pressure foam as it is being released through the barrel to the borehole bottom. As shown in FIG. 5*a*, the poppet piston 76 is held firmly closed by using the high-pressure air from the air pad section 78 shown in FIG. 4 that has been ported to air cavity 80 through access port 89 shown in FIG. 5*b*. To open the poppet valve as shown in FIG. 5*b*, the high-pressure air in the cavity 80 is vented to the exterior via port 89 and by appropriate external valving. This allows the stored foam in the breaker to push open the annular poppet piston 76 to the left, thus uncovering the four slanted access ports 90 in the poppet core 77. The poppet core includes four access ports 90 equally spaced radially which allows the foam to escape through its throat 92 and into the barrel 4.

The unique annular poppet allows access to the borehole bottom for performing specific operations at the borehole bottom independently of the injection of high-pressure foam for breakage. For example, a small-charge propellant system could be used to provide a high-pressure pulse of short duration that initiates bottom hole fractures conducive to complete fragmentation of the material.

Such propellant charge add-on system would incorporate a rotating ball check valve within the throat 92 of the poppet core that can be used to feed a small propellant charge down the barrel preceding the injection of low-pressure foam or gel. The propellant charge could contain a pressure sensitive switch to ignite the propellant. Most, if not all, of the energy for breakage would come from the propellant. The propellant system can be deployed rapidly to fracture and break a uniquely hard compact material, whenever such might be encountered in normal CFI operations. Foam modifying substance may be fed directly into the bore of the barrel 4 through the poppet valve throat from opening 91. The foam modifying substances are chemicals such as cross-linking chemicals and small particles such as proppants used in oil and gas wells. Small particles include micro and nano-sized particles.

When CFI functioning does not require access to the bore of the barrel or the hole bottom, the simpler plug type poppet, as shown in FIG. 6 and discussed below, may be employed.

Figure 6C:
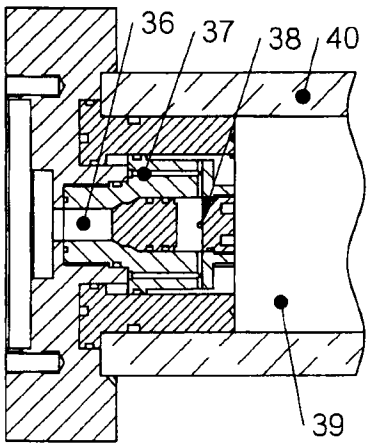
FIGS. 6*a*, 6*b* and 6*c* show three detailed cross-sectional views of a simplified poppet valve with a conical seat.
Figure 6B:
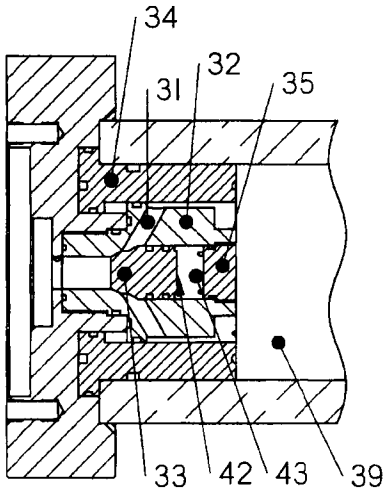
Figure 6A:
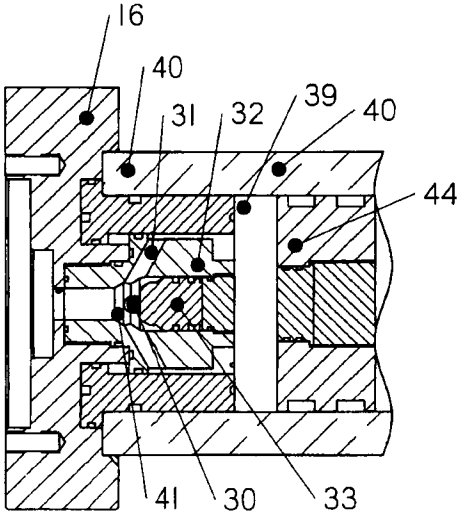

The unique poppet valve shown in FIGS. 6*a*, 6*b*, 6*c* and 7 mitigates potential leaks of the pressurized fluid 39 held in the breaker 40 from escaping down the barrel through the poppet outlet 36. This compact construction is backwards compatible with the main structural features of the breaker assembly depicted in FIG. 4 and FIG. 5. The breaker centerplate 16 and main cylinder 40 are identical in both figures. The poppet valve itself consists of three main components: The annular stationary core 32; the free piston 33; and the adapter cylinder 34. The core 32 provides both the valve seat 41 and the guide cylinder for the piston 33. In one embodiment, the piston 33 is made out of a hard maraging steel alloy, and the core 32 is made out of softer stainless steel. This provides a valve seat 41 whose surface imperfections may be deformable by the closing action of the piston 33. A solid plug 35 screws in to the back of the core 30 that allows for manual piston 33 insertion and removal. It also forms the backstop for the cylindrical chamber 43 that houses the piston 33. The geometry of the core 32 contains four large slanted holes 31 arranged perpendicular to each other that terminate at the junction of the valve seat 41. To close the poppet, pressurized air that matches that of the fluid in the breaker 39, is ported into the cylindrical poppet core chamber 43 via the four mutually perpendicular access ports 37 and 38. As depicted in FIGS. 6*b* and 6*c*, the gas pressure acting on circular end 42 displaces the piston 33 left and holds it firmly against the seat 41 thereby blocking the escape of the pressurized fluid in the breaker 39. To open the valve, the gas trapped behind the poppet piston 43 is released to ambient pressure. Having no opposing force, the pressurized fluid in the breaker acting on the front of the piston through ports 31, will displace the piston to the right as shown in FIG. 6*a*, thus enabling its escape through ports 30 and throat 36 shown in FIG. 6*c*.

Figure 7:
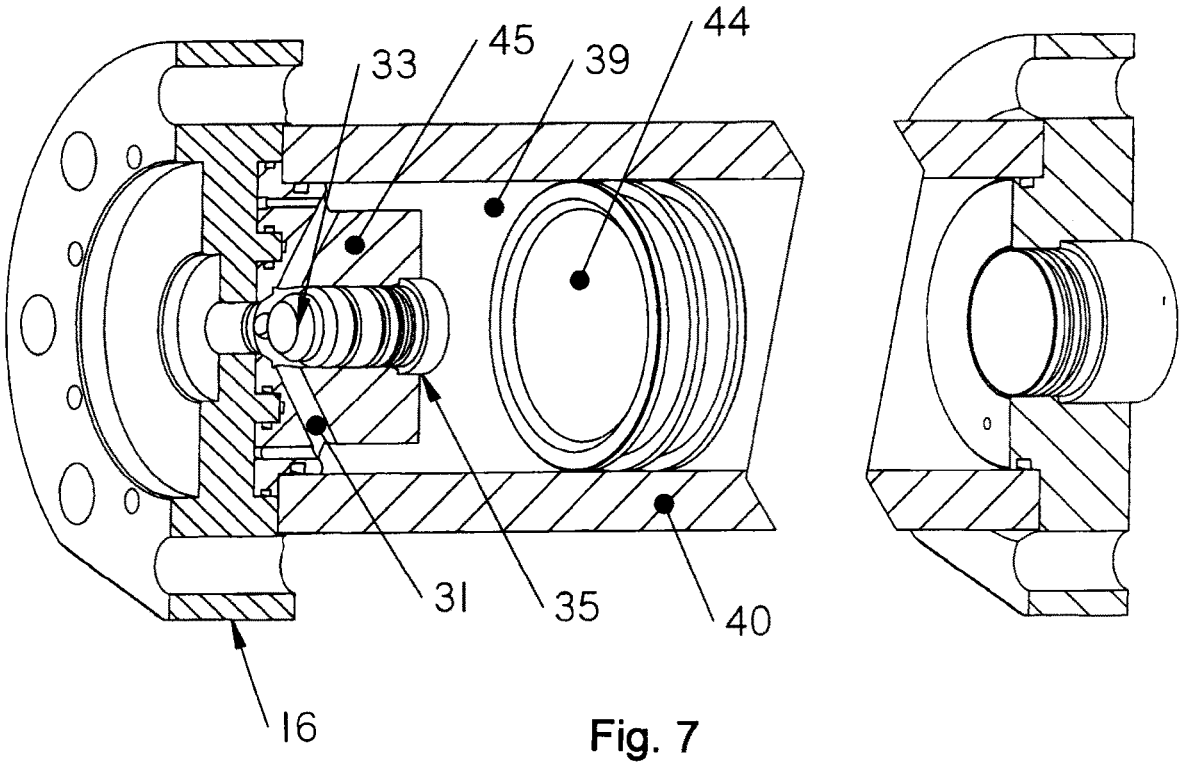
FIG. 7 is a foreshortened perspective cross-sectional view of the same poppet valve depicted in FIG. 6 with a reduced part count.

An alternate embodiment of this poppet configuration with a reduced part count is shown in FIG. 7. The annular adapter flange 34 has been combined with the core 32 as shown in FIGS. 6*a*, 6*b* and 6*c* has been made into one piece 45, thereby simplifying the overall construction and eliminating the need for the intermediary O-ring seals. During sudden discharge of the pressurized fluid 39, the floating piston 44 achieves substantial momentum that unless checked can result in damage to itself and or the poppet assembly. The annular adapter flange 34 serves as a forward stop to the floating piston assembly 44 and provides sufficient area to dissipate the impact without damage.

Shown in FIG. 8 is a plumbing diagram of the PLC controlled automated foam generating and delivery system. A foam generator 55 is attached to the breaker 59, via high pressure gas lines and associated valving 51-58. The foam generator mixes two primary components, namely the liquid phase that is over 95 percent water and the gas phase that is normal atmospheric air compressed to the desired foam pressure. The liquid phase may contain gels and thickeners to increase viscosity as well as surfactants comprising less than 2 percent of the liquid phase. By hydraulically displacing the piston core, the foam generator mixes both components through a static inline mixer 61. Standard check valves 56 control the direction of flow. The high-pressure gas entering ports 46 and 49 may be provided by any conventional compressor or intensifier system. Gel liquid through port 48 is supplied by a conventional high-pressure liquid pump through valve 52. Depending on operator selection, the system is capable of automatically sequencing the delivery three different types of loads to the breaker 59: foam; high viscosity foam; and or water. The PLC controls the state of the feed valves 51-54 and 58 as well as the internal hydraulic piston displacement of the foam generator 55. The system is also created to allow the operator to selectively pre-load the breaker barrel with water. Low viscosity water can be fed via port 50 through valves 54 and 58 to the breaker barrel, with the intention of initiating fractures at the bottom of the hole at lower relative foam pressures.

The PLC allows the operator to tailor the desired foam viscosity, injection pressure as well as the quantity and type of foam loads depending on the fragmentation characteristics of the material to be broken. For example, the operator can deliver additional foam loads to the breaker with the effect of increasing the injection pressure at the bottom of the hole. The operator could choose to only load low viscosity water charges into the breaker which is helpful in fracturing competent homogenous fine grained and low porosity rocks.

Figure 10:
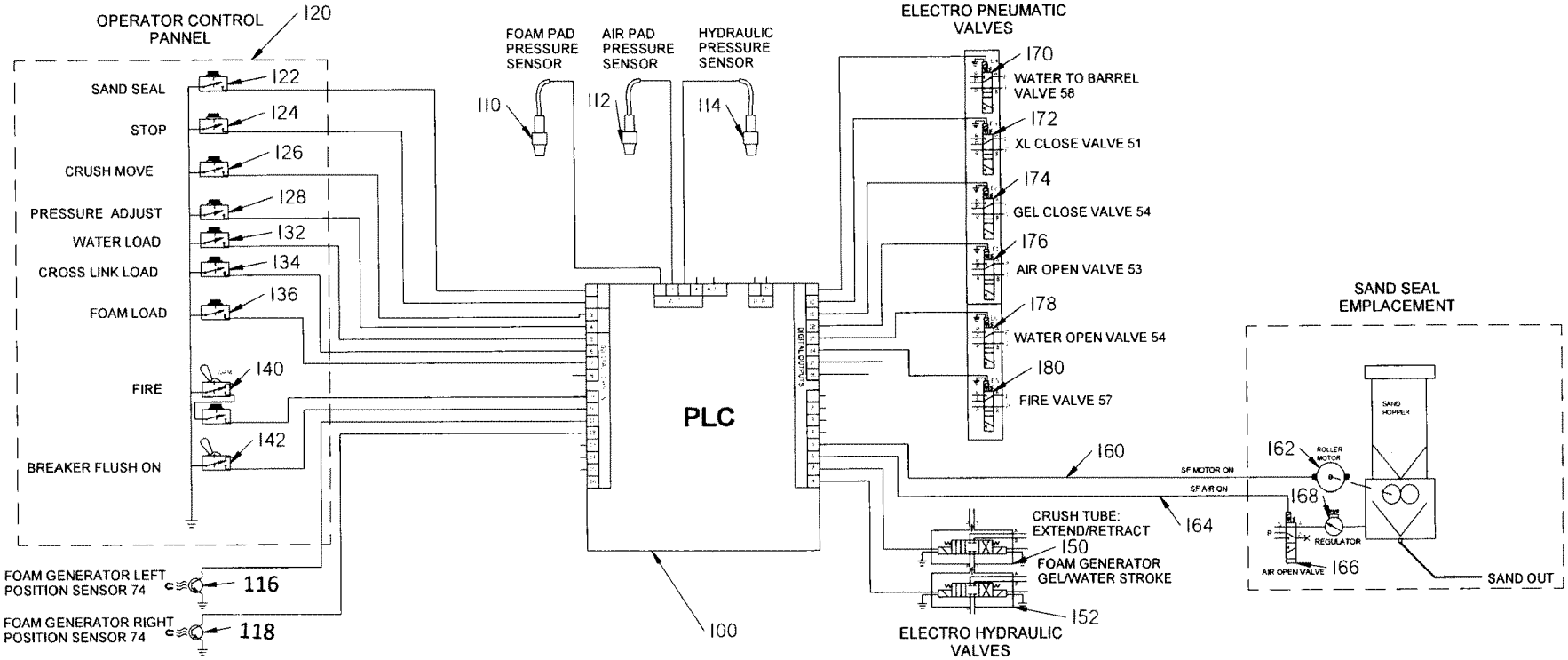
FIG. 10 is a schematic representation of the control.

Two electronic sensors, 112 and 110 in FIG. 10, monitor the air-pad and foam-pad pressures. For safety reasons, the PLC is programmed to automatically open the foam release valve 62 if overpressure or other failure conditions are detected by the PLC and/or operator.

One embodiment of the delivery system also includes a high-pressure regulator 60 in between the high-pressure gas line 49 and the input to the air cylinder 48 of the foam generator. The quality of the foam in the CFI breaker can be controlled between 50% to 0% quality (percent of gas) by varying the pressure in the gas cylinder 48 through the pressure regulator 60. This regulator can lower the effective pressure in the gas cylinder as compared to the pressure of the air pad section 78 of the breaker 59, thus resulting in lower pressure foam being delivered to the water/foam cylinder of the foam generator 55. When this foam is delivered to the breaker it is compressed up to the air pad pressure in chamber 78. Consequently, this compression will reduce the gas quality of the foam being delivered to the breaker. Use of a lower quality foam at the pre-determined pressure for rock breakage would result in the reduction of air blast and fly rock.

The automated foam generation and delivery system of FIG. 8 can be mounted directly on the rock or concrete breaking machine utilizing the built-in diesel/hydraulic or electric/hydraulic power sources. Alternatively, the automated foam generation and delivery system can be mounted on a separate "power pack" machine that incorporates the necessary power sources and is attached or towed behind the rock or concrete breaking unit and is connected by means of high-pressure flexible tubing and hoses.

Figure 9:
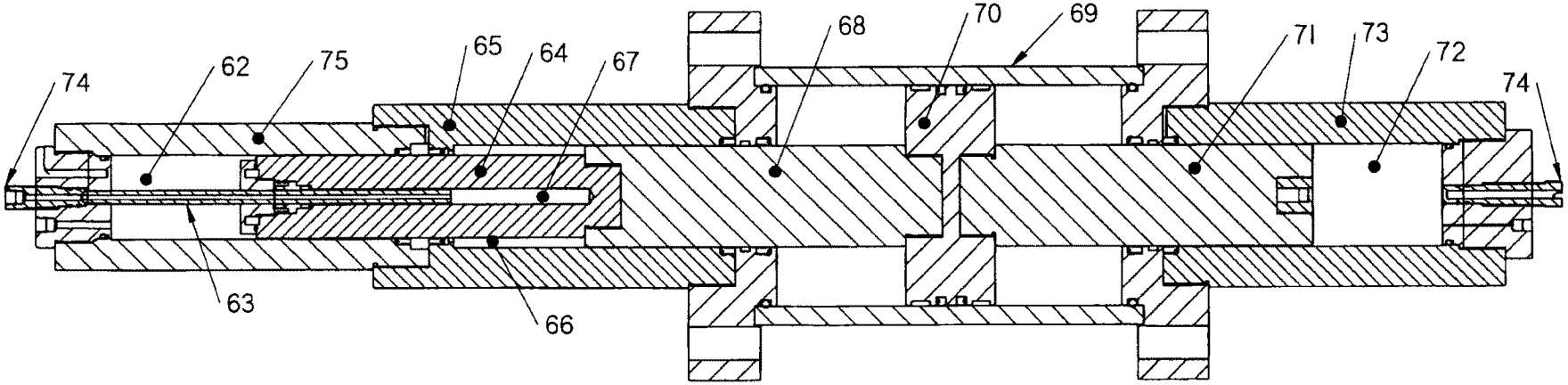
FIG. 9 is a cross sectional view of the compact foam generator apparatus with the piston core assembly centered.

FIG. 9 shows a detailed cross-sectional side view of a compact high-pressure foam generator. As detailed in U.S. Pat. No. 6,375,271, the foam generator is composed of a concentric outer cylinder assembly that houses an internal piston core. The cross link piston 63 and cylinder assembly 67 are housed internally, thus shrinking the foam generator's footprint and providing additional safety margin in case of mechanical failure. In addition, embedded electronic position sensors 74 at either end of the foam generator provide the PLC with piston core position feedback information. The PLC controls both the direction of movement and start and stop timing of the piston core.

The small stationary diameter tubular rod 63 acts as a piston within the cylindrical cavity 67 and is used to inject cross-linking liquid 47. The micro-metering cylinder 67 is incorporated within the Gel piston 64 and functions like a syringe, thus delivering the chemical solution on a proportional basis to the piston core leftward displacement.

Because the use of organic polymers was found to suffer significant viscosity losses at high shear rates, other additives were investigated for the purpose of increasing foam viscosities. Several insoluble materials of small particle size and unique shape were studied. The effect of such particles is to prevent the escape of pressurized foam through narrow fractures. Both manufactured and naturally occurring materials were found to have the desired effect. Partial blockage of fractures slows down the foam pressure dissipation resulting in more uniform and thorough breakage. Use of clay additives, such as Montmorillonite has been found to be quite effective. The tabular, thin-sheet geometry serves to improve grain to grain interlocking thus making the plugging of a developing fracture more readily achieved. Other comparable clays or insoluble minerals could be used.

FIG. 10 is a schematic representation of the control system that shows the PLC 100 and its main sensors, the foam pad pressure sensor 110, the air pad pressure sensor 112 and the hydraulic sensor 114, foam generator left position sensor 116 and right position sensor 118.

The operator control panel 120 has button switches for sand seal 122, stop 124, seal crush 126, pressure adjustment 128, water load 132, cross link load 134 and foam load 136.

Seal button 122 starts a sand seal delivery and emplacement cycle. Fire switch 140 sequences the sudden discharge of the breaker to release the foam load into the material to be broken. Breaker flush switch 142 starts water and pressurized air to remove the crushed sand seal. Two important electro hydraulic valves are the crush tube extend and retract valves 150 for crushing and packing the sand seal and the foam generator gel/water stroke valves 152 for displacing the foam generator piston core to either end.

PLC output 161 turns the sand metering rollers motor 162 on and switch 164 operates air valve 166 that pressurizes the sand delivery system as set by regulator 168.

Water to barrel valve 170 controls pre-loading the barrel with low viscosity fluid. Valve 172 opens and closes the supply of foam modifying substance to the foam generator. The foam modifying substance may be a chemical or chemicals, for example cross-linking chemicals or small particles which are supplies or small-charge propellants.

Gel close valve 174 controls the flow of gel to the foam generator. Air and water open valves 176, 178 control high pressure air and water to the foam generator.

Fire valve 180 allows the sudden discharge of the poppet back pressure in order to release the foam load in the breaker.

While the invention has been described with reference to specific embodiments, modifications and variations of the invention may be constructed without departing from the scope of the invention, which is defined in the following claims.

We claim:

1. Apparatus comprising:

a rock or concrete breaker further comprising:

a barrel having a proximal end and a distal end, a conical tip bulb radially extending from the distal end of the barrel and configured for fitting within a borehole and pressing against an inner wall of the borehole, a proximal end of the conical tip bulb being configured as a cone for capturing and pressing particulate sealing material against the inner wall of the borehole, a crush tube having a proximal end and a distal end and concentrically mounted externally on the barrel and configured for sliding back and forth on the barrel with the distal end of the crush tube variably spaced from the tip bulb on the distal end of the barrel, for packing particulate sealing material in an annular seal cavity formed between the barrel and the inner wall of the borehole, the distal end of the crush tube and the tip bulb, a groove extending lengthwise along an exterior surface of the barrel, the groove having a distal end and a proximal end, a nose cone having a proximal end and a distal end and configured for holding the proximal end of the barrel, a cylinder mounted in the nose cone with an inner piston configured for receiving and securing the proximal end of the crush tube and driving the crush tube back and forth on an outer surface of the barrel, between an extended position and a retracted position, first and second inlets in the nose cone, the first inlet being configured for connecting with the proximal end of the groove when the crush tube is in the retracted position, the second inlet positioned in the nose cone and configured for connecting with the groove when the crush tube is in an at least partially extended position, a particulate sealing material and a delivery fluid selectively connected to and disconnected from the first inlet and configured for providing the particulate sealing material by the delivery fluid to the first inlet and through the first inlet, through the groove and out of the groove to the annular seal cavity formed between the barrel, the inner wall of the borehole and limited lengthwise by the distal end of the crush tube and the conical tip bulb, wherein the particulate material is trapped in the annular seal cavity by the distal end of the crush tube and the conical tip bulb, and the piston connected to the proximal end of the crush tube adapted for reciprocating the crush tube toward and away from the conical tip bulb and packing the particulate sealing material radially outward so as to form a tight annular seal of highly crushed and compacted particulate sealing material in the annular cavity, a wash out fluid selectively connected to and disconnected from the second inlet and configured for delivering wash out fluid through the second inlet and the groove, cleaning out the annular seal cavity between the inner wall of the borehole, the barrel, the distal end of the crush tube and the conical tip bulb during at least a portion of travel of the crush tube relative to the barrel.

2. The apparatus of claim 1, wherein the particulate sealing material is in a hopper holding the particulate material, and the delivery fluid is connected to the hopper, a metering chamber is connected to the hopper and a first conduit connects an outlet of the metering chamber to the first inlet of the nose cone.

3. The apparatus of claim 2, further comprising metering rollers in the metering chamber and a delivery fluid inlet connected to the delivery fluid and to the metering chamber for conducting delivery fluid through the conduit, the first inlet and the groove with or without the particulate sealing material.

4. The apparatus of claim 2, wherein the delivery fluid is compressed air.

5. The apparatus of claim 1, the wash out fluid further comprising compressed air and water and a conduit connected to the compressed air and water and to the second inlet in the nose cone for delivering the compressed air and water through the second conduit, the second inlet and the groove in the barrel to the annular seal cavity as cleanout fluid.

6. The apparatus of claim 1, wherein the particulate sealing material is sand and the delivery fluid is compressed air.

7. The apparatus of claim 1, further comprising:

a foam cylinder having a first foam chamber and a second driving chamber, a piston dividing the first foam chamber and the second driving chamber, the first chamber connected to the barrel, a foam generator connected to the first chamber adapted for filling the first chamber with foam, a pressure conduit connected to the second chamber adapted for driving the piston toward the barrel and compressing the first chamber, a smaller foam property modifying substance injection cylinder connected to the piston and extending into the second chamber, a smaller injection tube acting as an injection piston mounted in the injection cylinder, the injection tube having first and second ends, the first end of the injection tube connected to a poppet valve having a connection to the barrel, and the second end of the injection tube mounted in the injection cylinder and adapted for providing the pressurized foam property modifying substance from the injection cylinder through the poppet valve as the piston and the injection cylinder are moved toward a first end of the foam cylinder.

8. The apparatus of claim 7, wherein the poppet valve has an annular poppet cylinder, an annular poppet piston in the poppet cylinder and a poppet core with a through hole connected to the barrel, the poppet piston being held closed by pressurized air, the poppet valve being adapted so that when the air pressure holding the poppet closed is reduced by an external valve the annular poppet cylinder opens to deliver foam from the first end of the foam cylinder through the poppet valve and the core to the barrel while at the same time the movement of the foam property modifying substance cylinder within the second driving chamber increases pressure in the smaller injection tube, opening a check valve and delivering the foam property modifying substance under pressure to the through hole in the poppet core.

9. Apparatus of claim 7 further comprising:

the poppet valve configured for delivering the foam under pressure from the injection cylinder through the barrel in the borehole, the poppet valve further comprising:

an annular poppet cylinder, an annular poppet piston in the poppet cylinder, a poppet core inside the annular poppet piston, an open throat within the poppet core, and access ports configured for closing by the annular poppet piston and preventing communication between the foam cylinder and the open throat in the poppet core.

10. The apparatus of claim 9, further comprising an annular fluid chamber, and configured wherein the annular poppet piston is held closed until pressure is reduced by an external valve.

11. A method comprising:

providing a barrel having a conical tip bulb configured for inserting into a drilled borehole in a rock or concrete for fracturing the rock or concrete, providing a crush tube slidable on the barrel, the crush tube having a distal end spaced from the conical tip bulb, providing a lengthwise groove along an outer surface of the barrel, providing a nose cone adapted for holding a cylinder against a center plate that is adapted for holding the barrel and permitting sliding through the nose cone of a proximal end of the crush tube on the barrel, providing first and second passages in the nose cone, providing sand and air under pressure through the first passage in the nose cone and the groove along the outer surface of the barrel to a gap between the bulb tip and the distal end of the crush tube, closing the first passage and advancing the crush tube on the barrel and moving the distal end of the crush tube toward the tip bulb, crushing the sand between the tip bulb and the distal end of the crush tube, thereby forming a crushed sand seal between the barrel and an interior wall of the borehole, wherein the sand is trapped in a seal cavity by the crush tube end and the conical tip bulb, and providing foam and a cross linker through a bore of the barrel and into a bottom of the sealed borehole.

12. The method of claim 11, further comprising introducing water and compressed air through the second passage and the groove into the crushed sand seal and eroding the sand seal for facilitating removal of the barrel from the borehole.

13. The method of claim 12, further comprising reciprocating the crush tube and further facilitating erosion and removal of the sand seal.

14. The method of claim 11, wherein the providing of sand and air under pressure further comprises:

providing a sand hopper, providing sand in the sand hopper, providing metering rollers beneath the sand hopper, and providing a flow of pressurized air below the metering rollers and through a first passageway and the groove along the barrel, thereby keeping the first passageway and the groove free of debris, moisture and sand.

15. The method of claim 14, further comprising flowing pressurized air into the sand hopper and rotating the metering rollers and flowing the sand and pressurized air from the sand hopper through the first passageway and the groove to an annular cavity between the tip bulb and the distal end of the crush tube.

16. The method of claim 11, further comprising:

providing a foam cylinder, providing foam from the foam cylinder to the barrel through a poppet valve, providing the poppet valve with an annular poppet chamber, an annular poppet piston within the annular poppet chamber, and a poppet core having a throat adapted for connection to a bore of the barrel, providing the poppet valve with passageways from the foam cylinder to the throat, providing an annular air chamber behind the annular poppet piston and closing the passageways with the poppet piston with air pressure in the air chamber, and using an external valve for reducing the air pressure holding the poppet closed, thus allowing for the injection of high pressure foam into the bore of the barrel and out through the distal end of the barrel.

17. The method of claim 16, further comprising:

providing a foam property modifying substance to the foam in the throat and in the barrel by extending a foam property modifying substance cylinder from a foam piston into an air drive chamber on a side of the foam piston opposite a foam chamber, extending a hollow foam property modifying substance tube piston from the poppet valve through the foam chamber and through the foam piston into a cross-linker cylinder, moving with the foam piston the foam property modifying substance cylinder onto a hollow cross linker piston and increasing pressure on the cross linker in the hollow piston, opening a one-way valve in the poppet valve with the increased cross linker pressure, and ejecting the foam property modifying substance from the hollow foam property modifying substance piston into the poppet valve throat.

18. The method of claim 17, wherein the ejecting of the foam property modifying substance further comprises ejecting one or more foam cross-linking chemicals.

19. The method of claim 17, wherein the ejecting of the foam property modifying substance further comprises ejecting particles, micro-particles or nanoparticles.

20. The method of claim 17, wherein the ejecting of the foam property modifying substance further comprises ejecting a combination of foam cross-linking chemicals and micro particles into the poppet valve throat.

* * * * *